US005095824A

United States Patent [19]

Schultz

[11] Patent Number: 5,095,824

[45] Date of Patent: Mar. 17, 1992

[54] OUTSIDE STAKE CAP FOR RAILROAD HOPPER CARS

[75] Inventor: Lawrence L. Schultz, Orland Park, Ill.

[73] Assignee: Salco Products, Inc., Romeoville, Ill.

[21] Appl. No.: 665,684

[22] Filed: Mar. 7, 1991

[51] Int. Cl.[5] ..... B61D 7/00

[52] U.S. Cl. ..... 105/247; 105/355; 105/404; 105/380

[58] Field of Search ..... 105/404, 411, 380–392, 105/377, 406.1, 355, 247, 248, 249, 250, 251, 252, 253, 463.1, 424; 280/380, 143, 144; 296/36, 43; 403/252, 280; 256/59, 65

[56] References Cited

U.S. PATENT DOCUMENTS

| | | | |
|---|---|---|---|
| 3,822,053 | 7/1974 | Daily | 256/65 |
| 3,871,702 | 3/1975 | Glassmeyer | 296/36 |
| 3,910,561 | 10/1975 | Fornells | 256/59 |
| 4,014,520 | 3/1977 | Walters | 256/59 |
| 4,042,275 | 8/1977 | Glassmeyer et al. | 296/43 |
| 4,369,953 | 1/1983 | Greiner et al. | 256/59 |
| 4,427,230 | 1/1984 | Avny | 105/380 |
| 4,668,000 | 5/1987 | Jokela | 296/43 |

FOREIGN PATENT DOCUMENTS

| | | | |
|---|---|---|---|
| 2612231 | 9/1988 | France | 256/59 |

*Primary Examiner*—Robert J. Oberleitner
*Assistant Examiner*—Mark T. Le
*Attorney, Agent, or Firm*—Kinzer, Plyer, Dorn, McEachran & Jambor

[57] ABSTRACT

A stake cap is provided for covering the upper opening of an outside stake of a railroad hopper car. The stake cap has a retainer plate having front and rear surfaces which define top, bottom and side edges. The side edges are beveled such that the front surface of the retainer plate is wider than the rear surface. A top sheet is joined at a right angle to the top edge of the retainer plate. Gussets strengthen the connection of the top sheet and retainer plate. When the stake cap is installed in the upper opening of a stake, the beveled side edges of the retainer plate form themselves to the stake and are wedged between the stake and the hopper car outside shell. The top sheet overlies the opening and prevents entry of contaminants and water.

8 Claims, 1 Drawing Sheet

OUTSIDE STAKE CAP FOR RAILROAD HOPPER CARS

BACKGROUND OF THE INVENTION

This invention relates to railroad hopper cars and is particularly concerned with the reinforcing stakes found on the exterior walls or shells of such cars. These stakes are typically rolled sections or channels which define a generally hat-shaped cross section. They are placed vertically on the exterior shell of a hopper car. The stakes are left open at the top which permits entry of contaminants such as spilled lading. Rain and snow obviously will also enter the interior of the stakes.

When lading, such as wheat, oats, fertilizer, resins, salt etc., is spilled during loading of the car it can find its way into the interior of the stakes. Such spilled material can collect inside the stakes where it eventually will begin to rot. The results are not pleasant to those who have to work around the car. It also lends an unsanitary air to the shipment of grains and the like, even though the lading inside the car is itself in good condition.

Another undesirable effect of open stakes is the entry of water, ice and snow leads to rust at the bottom of the stakes. It would of course be preferable to prevent access of the moisture that leads to corrosion.

The stake cap of the present invention provides an economical way to close the top of the stakes and thereby preclude development of the problems just mentioned.

SUMMARY OF THE INVENTION

A primary object of the present invention is a stake cap for railroad hopper cars that prevents entry of material to the inside of the stake.

An additional object of the invention is a stake cap which can be installed quickly without special tools and without modification to the hopper car.

Another object of the invention is a stake cap which is durable in use and cannot be easily dislodged from the stake.

Another object of the invention is a stake cap of the type described which can be economically manufactured in a one-piece plastic molding.

These and other objects which may become apparent are realized by a stake cap designed to cover the upper opening of a railroad hopper car stake. The stakes themselves are attached to the exterior shell of the car. Each stake has a hat-shaped cross section defined by a pair of flanges, a pair of side walls and a connecting web. The flanges are attached more or less flush to the exterior shell. Each flange merges at a radius with a first edge of a perpendicular side wall. The side walls extend generally normal to the plane of the exterior shell. The side walls are joined at their second edges by a web which is spaced from and parallel to the shell of the car. The top of the stake defines an upper opening.

The stake cap has a retainer plate including top and bottom edges and a pair of side edges connecting the top and bottom edges. The retainer plate has front and rear surfaces arranged with the rear surface adjacent the car exterior shell when the stake cap is placed in the upper opening of the stake. The side edges are beveled and engageable with the radii of the flange-to-side wall joint when the stake is in place. That is, the beveled side edges form themselves to the stake and become wedged between the radii and the car exterior shell. This retains the stake cap in the upper opening of the stake.

The stake cap further includes a top sheet attached to the top edge of the retainer plate. The top sheet extends at a right angle to the retainer plate and overlies the upper opening of the stake to prevent access to the inside of the stake.

DETAILED DESCRIPTION OF THE INVENTION

Figure 1:
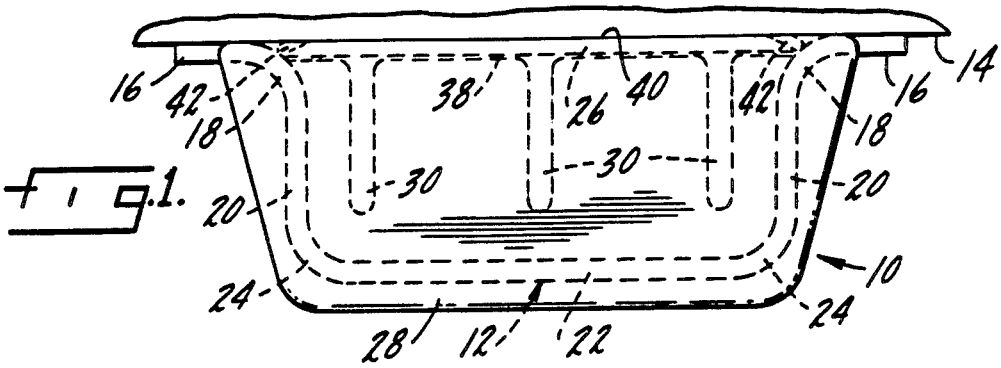
FIG. 1 is a top plan view of the stake cap of the present invention, shown placed in a hopper car stake.
Figure 2:
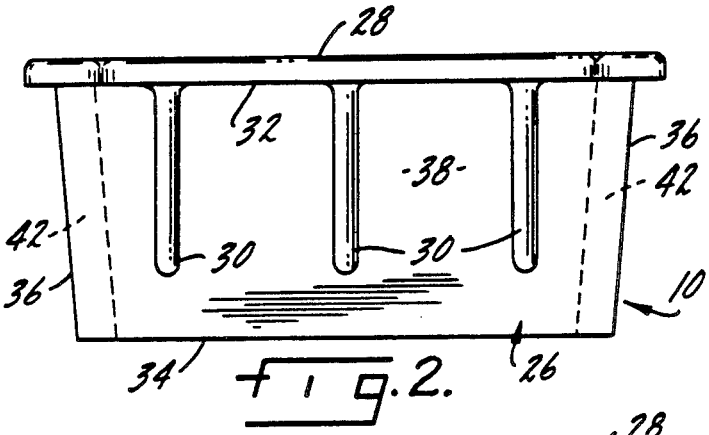
FIG. 2 is a front elevation view of the stake cap.
Figure 3:
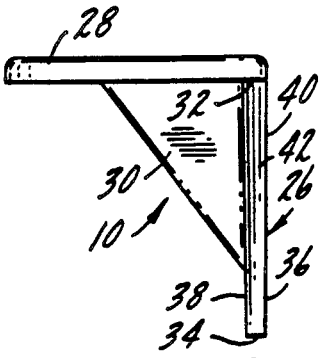
FIG. 3 is a side elevation view of the stake cap.
Figure 4:
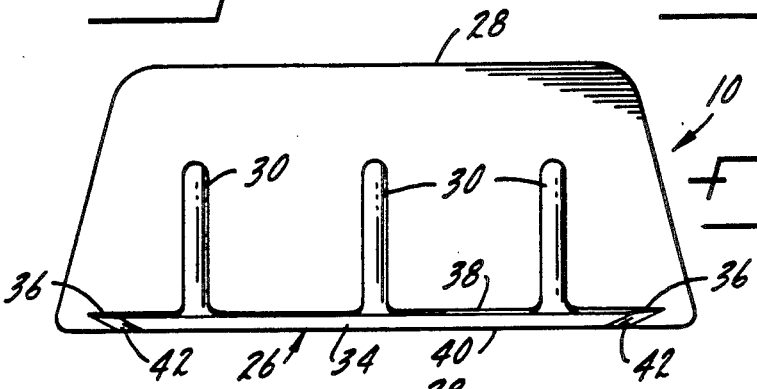
FIG. 4 is bottom plan view of the stake cap, shown installed in a stake.
Figure 5:
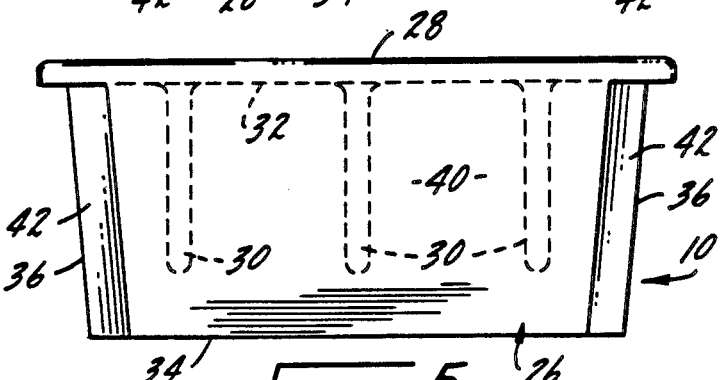
FIG. 5 is a rear elevation view of the stake cap.

The stake cap of the present invention is shown generally at 10 in FIGS. 1-5. FIG. 1 also shows a cross section of the stake 12 which is attached to the exterior shell or wall 14 of a railroad hopper car. The stake has a hat-shaped cross section defined by a pair of flanges, two sides walls and a web. It will be understood that the stakes extend vertically along the exterior shell of he hopper car for a distance of approximately eight feet. The top of the stake defines an upper opening which the stake cap of the present invention is intended to close or cover.

Looking now in detail at the stake, the flanges are shown at 16. They are generally flush with the exterior wall 14 of the hopper car. The flanges merge at radii 18 with perpendicular side walls 20. The side walls are generally perpendicular to the exterior shell of the car. A web 22 connects the perpendicular walls 20 at radii 24.

For purposes of illustration, the stake may have the following dimensions. The overall width from the tip of one flange 16 to the other is $7\frac{3}{4}$ inches. The width of a flange from its tip to the inside edge of the adjacent wall 20 is $1\frac{3}{8}$ inches. This leaves a 5-inch span between the inside edges of the walls 20. The outside surface of the web is $2\frac{1}{2}$ inches from the inside surface of the flanges 16. The material of the stake is 7/32-inches thick. The radii 18 and 24 are all about a half inch.

Turning now to the stake cap 10, the cap comprises three main elements. There is a retainer plate 26 connected to a top sheet 28 with the connection braced by gussets 30. The stake cap is preferably molded from suitable plastic material such as HDPE.

Looking at details of the retainer plate 26, the plate has top and bottom edges 32, 34 and a pair of side edges 36. The plate defines front and rear surfaces 38 and 40.

The side edges 36 of the retainer plate are beveled as shown at 42. The bevel is cut such that the width of the rear surface 40 is less than the width of the front surface 38. This is perhaps best seen in FIGS. 4 and 5. The bevel 42 is cut so that it forms an angle of about 25 degrees with the horizontal line defined by rear surface 40.

It will also be noted that the top edge 32 of the retainer plate is wider than the bottom edge 34. In a preferred embodiment, this is accomplished by tapering the side edge 36 at about five degrees from the vertical.

The top sheet 28 is connected to the retainer plate 26 along the top edge 32 of the retainer plate. The top sheet has a generally trapezoidal configuration with rounded corners. As seen in FIG. 1, this shape permits it to completely cover the upper opening of the stake.

Three gussets 30 are molded into the stake cap to reinforce the joint between the top sheet and retainer plate. The gussets are sized to fit down into the stake when the cap is in place. Thus, the gussets do not interfere with the stake.

The use and operation of the invention are as follows. To install the cap, it is placed in the upper opening of the stake with the retainer plate 26 in a vertical plane adjacent the exterior shell 14 of the car. With the vertical taper of the side edges as it is, the lower or bottom edge 34 of the cap is narrower than the space between the flanges 16 of the stake. The cap can simply be pushed in by hand until the side edges 36 engage the radii 18. From that point the cap can be hammered down into position until the underside of the top sheet engages the top edge of the stake. During this process, the beveled side edges form themselves to the shape of the space between the radius 18 and the wall 14. The beveled edge allows the retainer plate to become wedged in that space. This permits a tight fit between the cap and stake which prevents the stake from coming out.

Once the stake is in place, it can be seen that the top sheet prevents access of contaminants into the stake.

Whereas a preferred form of the invention has been shown and described, it will be realized that modifications may be made thereto without departing from the scope of the following claims.

I claim:

1. In a railroad hopper car of the type having an exterior shell an a plurality of vertical stakes attached to the exterior shell, each stake having a hat-shaped cross section including a pair of flanges each of which merges at a radius with a first edge of perpendicular side walls which are joined at their second edges by a web, the flanges being attached to the exterior shell, and the top of the stake defining an upper opening, the improvement comprising a stake cap for covering the upper opening of the stake, the stake cap comprising:

a retainer plate having to and bottom edges and a pair of side edges connecting the top and bottom edges, the retainer plate being beveled at the side edges and having front and rear surfaces such that when the stake cap is placed in the upper opening of the stake the side edges are engageable with said radii of the stake, between the radii and the car exterior shell with the rear surface adjacent the car exterior shell, and;

a top sheet attached to the retainer plate and extending at an angle thereto so as to overlie the upper opening of the stake.

2. The stake cap of claim 1 wherein the side edges are beveled such that the front surface of the retainer plate is wider than the rear surface.

3. The stake cap of claim 1 wherein the top edge of the retainer plate is wider than the bottom edge.

4. The stake cap of claim 2 wherein the top edge of the retainer plate is wider than the bottom edge.

5. The stake cap of claim 1 wherein the top sheet is connected to the top edge of the retainer plate.

6. The stake cap of claim 1 further comprising at least one gusset joining the front surface of the retainer plate and the top sheet.

7. The stake cap of claim 6 wherein the top sheet has a size which extends beyond the web of the stake when the stake cap is installed in a stake.

8. The stake cap of claim 1 wherein the top sheet has a size which extends beyond the web of the stake when the stake cap is installed in a stake.

* * * * *